US012352063B1

(12) United States Patent
Arnold, Sr.

(10) Patent No.: US 12,352,063 B1
(45) Date of Patent: Jul. 8, 2025

(54) PORTABLE CANOPY FOOT STAND

(71) Applicant: Clinton Wesley Arnold, Sr., Hartford, CT (US)

(72) Inventor: Clinton Wesley Arnold, Sr., Hartford, CT (US)

( * ) Notice: Subject to any disclaimer, the term of this patent is extended or adjusted under 35 U.S.C. 154(b) by 0 days.

(21) Appl. No.: 18/581,555

(22) Filed: Feb. 20, 2024

(51) Int. Cl.
*E04H 12/22* (2006.01)
*E04H 15/02* (2006.01)

(52) U.S. Cl.
CPC ..... *E04H 12/2238* (2013.01); *E04H 12/2246* (2013.01); *E04H 12/2261* (2013.01); *E04H 15/02* (2013.01)

(58) Field of Classification Search
CPC ..... E04H 12/2238; E04H 12/2246; E04H 12/2261; E04H 15/02
USPC ..... 248/519, 910
See application file for complete search history.

(56) References Cited

U.S. PATENT DOCUMENTS 3,216,681 A * 11/1965 Tagliavia ..... E04H 12/2246 248/346.03
5,135,192 A * 8/1992 Winkler ..... E04H 12/2223 52/157
5,685,517 A 11/1997 Salibra
6,305,659 B1 * 10/2001 Metelski ..... A61B 90/25 248/910
6,619,610 B1 9/2003 Genovese
6,981,680 B1 * 1/2006 Gordon ..... E04H 15/58 248/910
7,213,869 B1 * 5/2007 McClellan ..... E04H 12/2238 248/346.03
7,353,833 B1 * 4/2008 Palmer ..... E04H 15/62 135/120.4
7,878,478 B2 2/2011 Gumm
8,312,888 B2 * 11/2012 Rees, Jr. ..... E04H 6/025 52/165
8,424,549 B1 4/2013 Goldsmith
8,439,058 B2 * 5/2013 Doell ..... E04H 12/2246 135/120.1
8,573,609 B1 * 11/2013 Moser ..... B62B 1/14 280/47.23
8,714,174 B1 5/2014 DeSousa
8,714,511 B2 * 5/2014 Zoeteman ..... A45B 11/00 248/537
8,789,549 B1 7/2014 Barnes
9,051,755 B2 * 6/2015 Heining ..... E04H 12/2253
(Continued)

FOREIGN PATENT DOCUMENTS

CA 3092308 A1 * 2/2022 ..... E04H 12/223
FR 1386189 A * 1/1965 ..... E04H 12/2238
(Continued)

*Primary Examiner* — Taylor Morris
(74) *Attorney, Agent, or Firm* — Kyle A. Fletcher, Esq.

(57) ABSTRACT

The portable canopy foot stand may include a base plate and mounting hardware. The portable canopy foot stand may be operable to detachably couple one or more canopy weights to an individual leg of a portable canopy. The portable canopy foot stand may couple to an anchor tab of the individual leg to enlarge the bottom of the individual leg such that the individual leg is prevented from pulling out of a leg slot of the one or more canopy weights. The one or more canopy weights may be stacked on top of the base plate at a plurality of legs of the portable canopy to resist movement of the portable canopy due to wind.

11 Claims, 5 Drawing Sheets

(56) References Cited

U.S. PATENT DOCUMENTS

| | | | | |
|---|---|---|---|---|
| 9,057,475 | B1 * | 6/2015 | Macfarlane | E04H 12/2238 |
| 9,404,282 | B2 * | 8/2016 | Andrews | E04H 15/62 |
| 9,534,413 | B2 * | 1/2017 | Ma | G09F 15/00 |
| 9,637,943 | B2 * | 5/2017 | Fiwek | E04H 12/2238 |
| 9,845,611 | B2 * | 12/2017 | Koerner | A01G 9/04 |
| 10,054,248 | B2 * | 8/2018 | Louden | B65D 25/00 |
| D851,195 | S | 6/2019 | Anderson | |
| 10,344,499 | B1 * | 7/2019 | Maenza | E04H 15/46 |
| 11,499,286 | B1 * | 11/2022 | Warford | E02D 27/32 |
| 2023/0313553 | A1 * | 10/2023 | Luo | E04H 12/2246 248/523 |

FOREIGN PATENT DOCUMENTS

| | | | | |
|---|---|---|---|---|
| FR | 2800412 | A1 * | 5/2001 | B28B 19/00 |
| FR | 2989103 | A1 * | 10/2013 | E04H 12/2246 |
| WO | 2010007517 | | 1/2010 | |

* cited by examiner

PORTABLE CANOPY FOOT STAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of outdoor canopies, more specifically, a portable canopy foot stand.

SUMMARY OF INVENTION

The portable canopy foot stand may comprise a base plate and mounting hardware. The portable canopy foot stand may be operable to detachably couple one or more canopy weights to an individual leg of a portable canopy. The portable canopy foot stand may couple to an anchor tab of the individual leg to enlarge the bottom of the individual leg such that the individual leg is prevented from pulling out of a leg slot of the one or more canopy weights. The one or more canopy weights may be stacked on top of the base plate at a plurality of legs of the portable canopy to resist movement of the portable canopy due to wind.

An object of the invention is to provide a base plate that may detachably couple to the bottom of an individual leg of a portable canopy.

Another object of the invention is to provide mounting hardware to couple the base plate to the anchor tab of the individual leg.

A further object of the invention is to provide a base plate that may support one or more canopy weights to hold a canopy in place.

These together with additional objects, features and advantages of the portable canopy foot stand will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable canopy foot stand in detail, it is to be understood that the portable canopy foot stand is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable canopy foot stand.

It is therefore important that the claims be regarded as including such equivalent construction insofar as they do not depart from the spirit and scope of the portable canopy foot stand. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
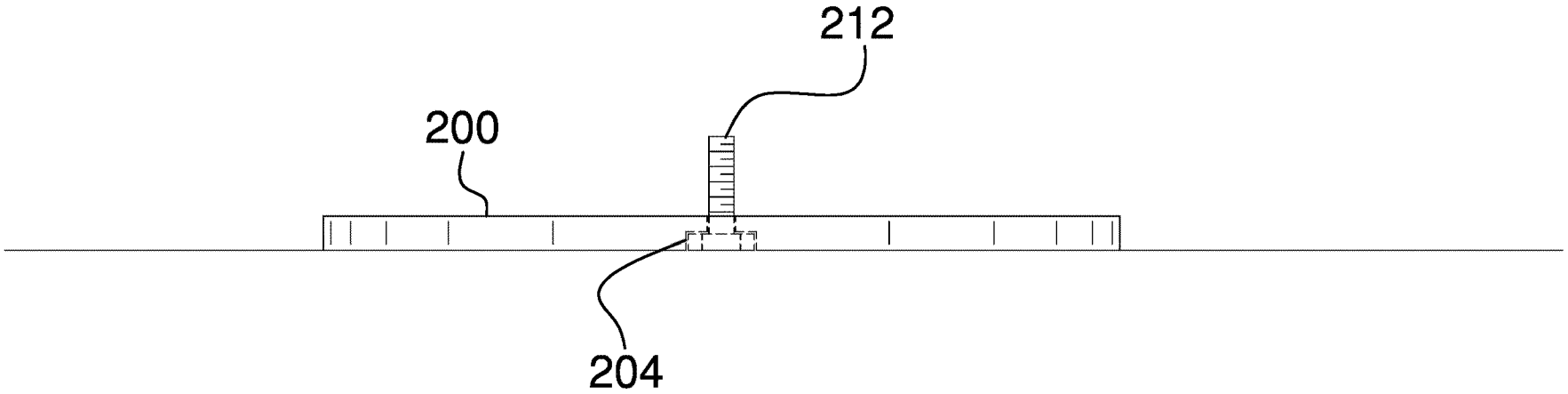
FIG. 1 is a front view of an embodiment of the disclosure.
Figure 2:
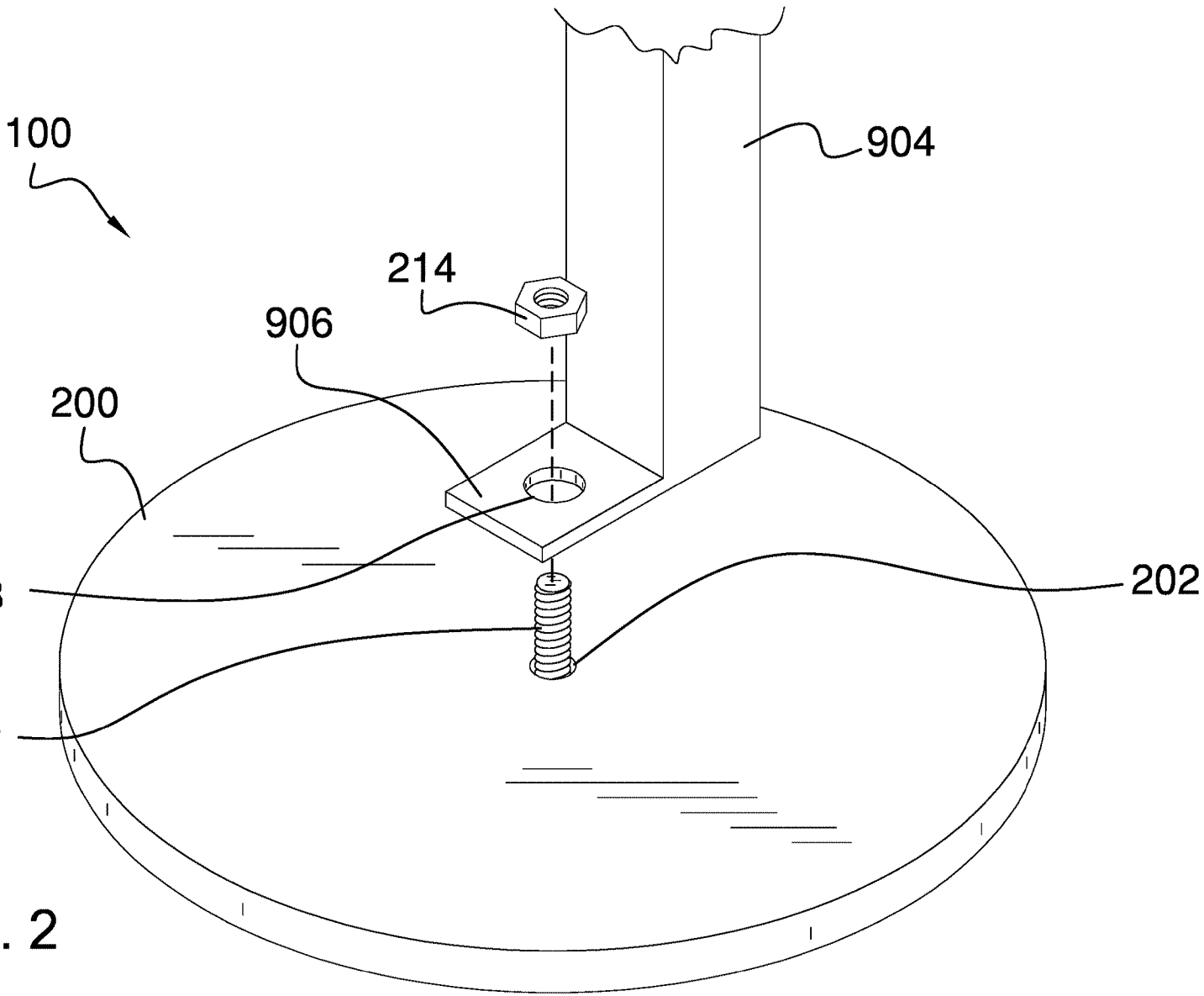
FIG. 2 is an isometric view of an embodiment of the disclosure.
Figure 3:
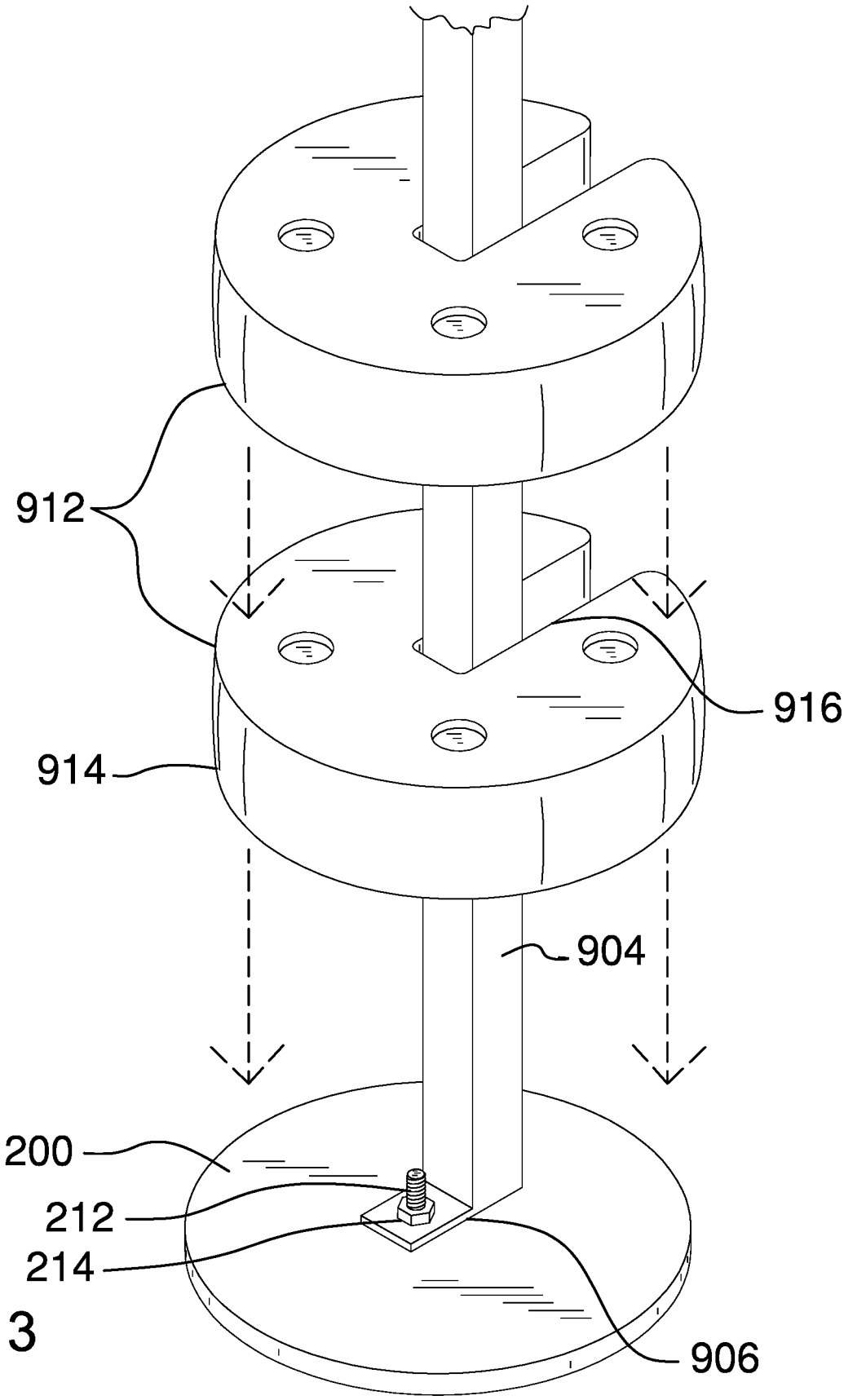
FIG. 3 is an in-use view of an embodiment of the disclosure, illustrating canopy weights being placed onto the base plate.
Figure 4:
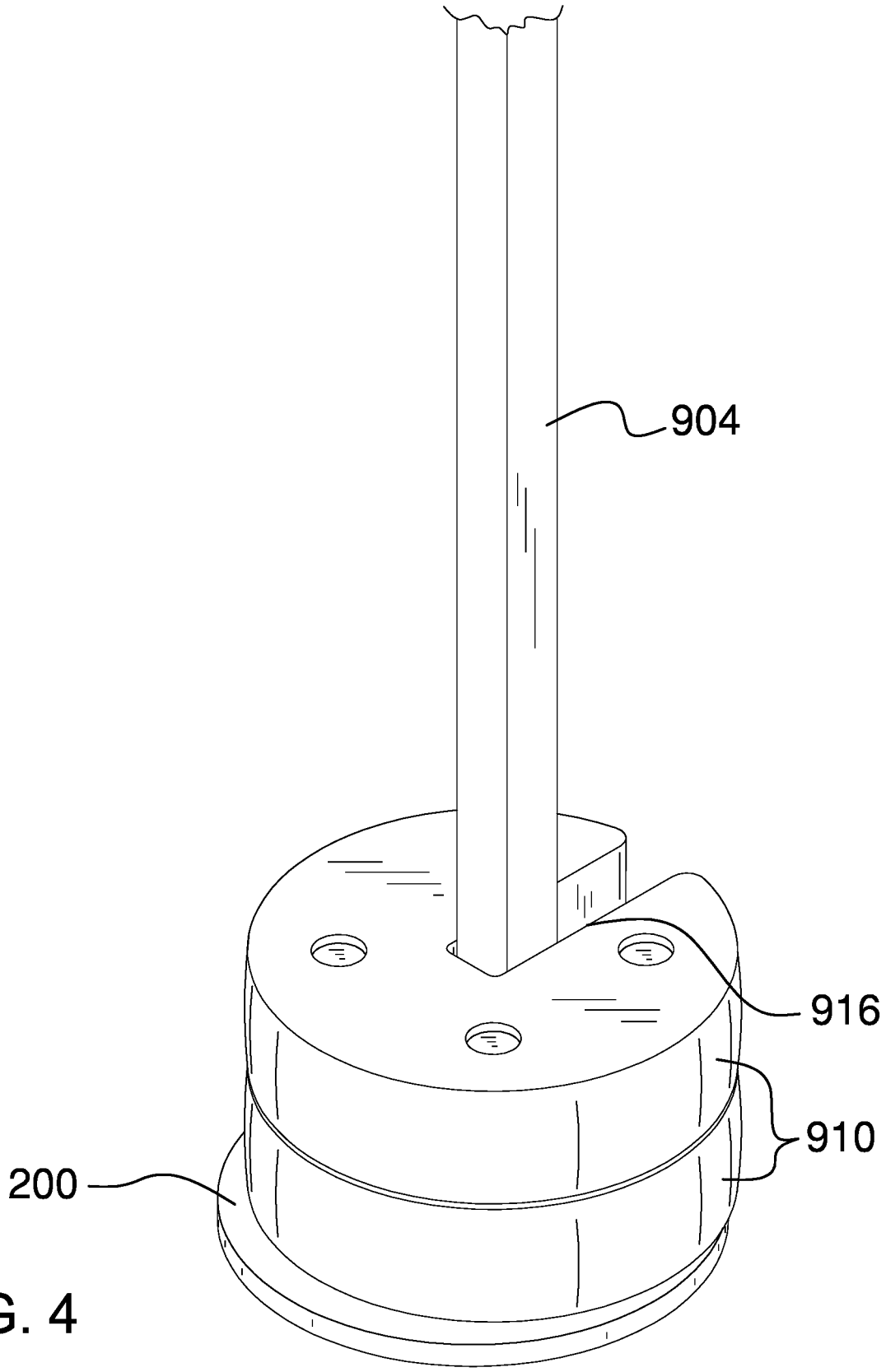
FIG. 4 is an in-use view of an embodiment of the disclosure, illustrating the canopy weights in place on the base plate.
Figure 5:
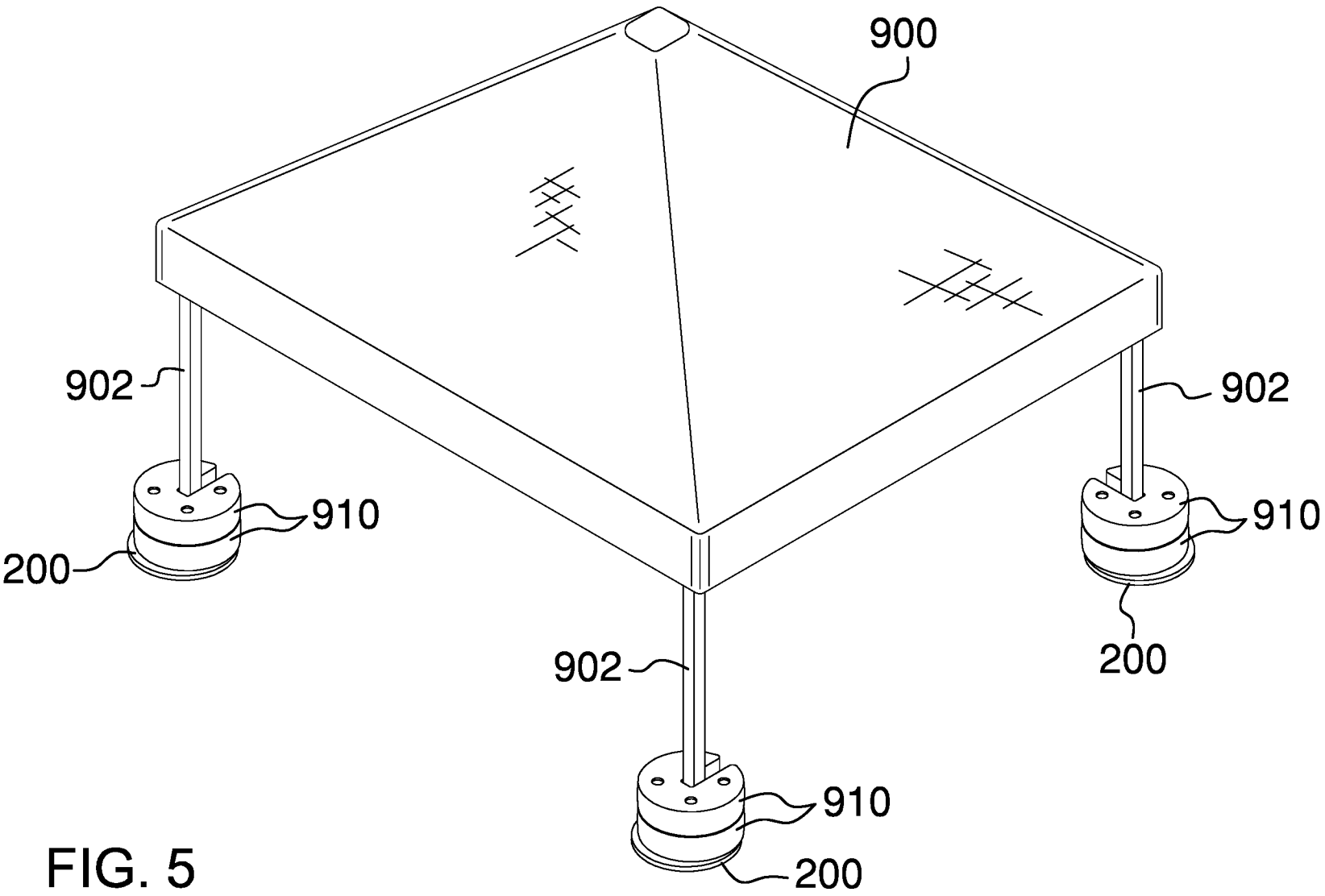
FIG. 5 is an in-use view of an embodiment of the disclosure, illustrating a canopy with a plurality of canopy weights in place at the bottom of each of the plurality of legs.

Detailed reference will now be made to a first potential embodiment of the disclosure, which is illustrated in FIGS. 1 through 5.

The portable canopy foot stand 100 (hereinafter invention) comprises a base plate 200 and mounting hardware. The invention may be operable to detachably couple one or more canopy weights 912 to an individual leg 904 of a portable canopy 900. The invention 100 may couple to an anchor tab 906 of the individual leg 904 to enlarge the bottom of the individual leg such that the individual leg 904 is prevented from pulling out of a leg slot 916 of the one or more canopy weights 912. The one or more canopy weights 912 may be stacked on top of the base plate 200 at a plurality of legs 902 of the portable canopy 900 to resist movement of the portable canopy 900 due to wind.

The base plate 200 may be a circular horizontal plate. The base plate 200 may be made from metal or plastic. In a preferred embodiment, the base plate 200 may have a diameter of 9.0 inches+/−0.5 inches. In a preferred embodiment, the base plate 200 may have a thickness of ¼ inch to ¾ inch.

The base plate 200 may detachably couple to the bottom of the individual leg 904 of the portable canopy 900 via the mounting hardware. The mounting hardware may comprise a bolt 212 and a nut 214. The bolt 212 may pass through the center of the base plate 200 and may extend above the top surface of the base plate 200. The base plate 200 may be coupled to the individual leg 904 by passing the upward extension of the bolt 212 through a stake aperture 908 of the anchor tab 906 on the individual leg 904 and by screwing the nut 214 tightly onto the bolt 212.

In some embodiments, the bolt 212 may pass through a base aperture 202. The base aperture 202 may be located at the center of the base plate 200 and may pass through the base plate 200 from bottom to top. In some embodiments, the bottom of the base plate 200 may comprise a bottom countersink 204 to encompass the head of the bolt 212 such that the bottom surface of the base plate 200 is flat.

In some embodiments, the bolt 212 may be a captive fastener coupled to the base plate 200.

The bolt 212 may be externally threaded. The nut 214 may be internally threaded. The external threading of the bolt 212 may be complementary to the internal threading of the nut 214 such that the nut 214 may threadedly couple with the bolt 212.

A plurality of canopy weights 910 may be used to hold the portable canopy 900 down by stacking the plurality of canopy weights 910 above the base plates 200 on each of the individual legs 904. An individual canopy weight 914 may be stacked by placing the individual canopy weight 914 directly onto the base plate 200 or by placing the individual canopy weight 914 on top of another one of the individual canopy weights 914 that is already stacked. The individual canopy weight 914 may be stacked by orienting the individual canopy weight 914 such that the leg slot 916 aligns with the individual leg 904, by moving the individual canopy weight 914 horizontally until the individual leg 904 is at the center of the individual canopy weight 914, and by lowering the individual canopy weight 914.

In use, a user may couple a base plate 200 to the bottom of each of the plurality of legs 902 of a portable canopy 900. The base plate 200 may be coupled to an individual leg 904 using the bolt 212 and the nut 214 to couple the base plate 200 to the anchor tab 906 of the individual leg 904. One or more canopy weights 912 may then be stacked on top of the base plate 200 to hold the individual leg 904 down. The individual canopy weight 914 may be stacked onto the base plate 200 by orienting the individual canopy weight 914 such that the leg slot 916 aligns with the individual leg 904, by lifting the individual canopy weight 914, by moving the individual canopy weight 914 horizontally until the individual leg 904 is at the center of the individual canopy weight 914, and by lowering the individual canopy weight 914.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" may be an opening in a surface or object. Aperture may be synonymous with hole, slit, crack, gap, slot, or opening.

As used in this disclosure, a "canopy" may be a cover, usually made of fabric, that is placed above an area to create a protected area within which people or objects are protected from the environment.

As used herein, "captive hardware" or "captive fastener" may refer to a type of fastener where at least one part of the fastener is retained by one of the parts that the fastener is intended to couple. A captive fastener is often made with thread locking, press-fitting, or broaching to accomplish an anchor-hold within a larger assembly housing. However, a captive fastener may also be melded with the material into which it is joined, either through cold forming or welding. Cage nuts and captive screws are non-limiting examples of captive hardware.

As used herein, "complement" or "complementary" may refer to a compatibility between threaded parts such that the gender, handedness, form, angle, pitch, diameter, and thread depth of both threads are compatible for the parts to mate by screwing the threads together. "Complement" and "complementary" may also be used to describe compatibility between geared parts and/or combinations of geared parts and threaded parts. As a non-limiting example, the worm screw and worm gear of a worm drive mechanism may be said to be complementary if the worm screw meshes with the worm gear and the worm screw is operable to turn the worm gear when the worm screw rotates.

As used herein, "countersink" may refer to a conical hole drilled into a part to allow a screw head to fit flush with a part's surface.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "external thread", "external threading", or "externally threaded" may refer to a thread located on an external surface of an item. Externally threaded items may mate with internally threaded items when the externally threaded item is placed into the internally threaded item and the items are screwed together via the threading. As a non-limiting example, pipe sections may couple using internal threading on one end to couple to external threading on an opposing end. External threading may also be known as exterior threading.

As used herein, "internal thread", "internal threading", or "internally threaded" may refer to a thread located on an internal surface of an item. Internally threaded items may mate with externally threaded items when the externally threaded item is placed into the internally threaded item and the items are screwed together via the threading. As a non-limiting example, pipe sections may couple using internal threading on one end to couple to external threading on an opposing end. Internal threading may also be known as interior threading.

As used in this disclosure, "horizontal" may be a directional term that refers to a direction that is perpendicular to the local force of gravity. Unless specifically noted in this disclosure, the horizontal direction is always perpendicular to the vertical direction.

As used herein, "mounting hardware" may refer to mechanical devices that are used to attach one object to another, including devices whose only purpose is to improve aesthetics. As non-limiting examples, mounting hardware may comprise screws, nuts, bolts, washers, rivets, crossbars, hooks, collars, nipples, cams, standoffs, knobs, caps, plates, rails, lips, brackets, or any combination thereof.

As used in this disclosure, a "plate" may be a flat, rigid object having at least one dimension that is of uniform thickness and is thinner than the other dimensions of the object. Plates often have a rectangular or disk like appearance. Plates may be made of any material, but are commonly made of metal.

As used herein, the word "portable" may refer to a device that may be carried by a single person and may be used at multiple locations. In some cases, portable may imply that the device may be used while being carried.

As used in this disclosure, a "slot" may be a prism-shaped negative space formed as a groove, cut, opening, or aperture in or through an object.

As used in this disclosure, a "tab" may be an extension of an object for the purpose of facilitating the manipulation of the object, identifying the object, or attaching the object to another object.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable canopy foot stand comprising:

a base plate, a nut, and a bolt;

wherein the portable canopy foot stand is operable to detachably couple one or more canopy weights to an individual leg of a portable canopy; wherein the portable canopy foot stand couples to an anchor tab of the individual leg to enlarge a bottom of the individual leg such that the individual leg is prevented from pulling out of a leg slot of the one or more canopy weights;

wherein the one or more canopy weights are stacked on top of the base plate at a plurality of legs of the portable canopy to resist movement of the portable canopy due to wind;

wherein the base plate detachably couples to the bottom of the individual leg of the portable canopy via the nut and bolt; wherein the bolt passes through a base aperture;

wherein the base aperture is located at a center of the base plate and passes through the base plate from a bottom surface to a top surface; and wherein the bolt is a captive fastener coupled to the base plate.

2. The portable canopy foot stand according to claim 1 wherein the base plate is a horizontal plate.

3. The portable canopy foot stand according to claim 2 wherein the base plate is circular.

4. The portable canopy foot stand according to claim 3 wherein the base plate has a diameter of 9.0 inches+/−0.5 inches.

5. The portable canopy foot stand according to claim 2 wherein the base plate has a thickness of ¼ inch to ¾ inch.

6. The portable canopy foot stand according to claim 2 wherein the base plate is made from metal or plastic.

7. The portable canopy foot stand according to claim 6 wherein the bolt extends above the top surface of the base plate; wherein the base plate is coupled to the individual leg by passing the upward extension of the bolt through a stake aperture of the anchor tab on the individual leg and by screwing the nut onto the bolt.

8. The portable canopy foot stand according to claim 7 wherein the bottom of the base plate comprises a bottom countersink to encompass a head of the bolt such that the bottom surface of the base plate is flat.

9. The portable canopy foot stand according to claim 6 wherein the bolt is externally threaded;

wherein the nut is internally threaded.

10. The portable canopy foot stand according to claim 9 wherein the external threading of the bolt is complementary to the internal threading of the nut such that the nut threadedly couples with the bolt.

11. The portable canopy foot stand according to claim 10 wherein a plurality of canopy weights are operable to hold the portable canopy down by stacking the plurality of canopy weights above the base plates on each of the individual legs;

wherein an individual canopy weight is stacked by placing the individual canopy weight directly onto the base plate or by placing the individual canopy weight on top of another one of the individual canopy weights that is already stacked;

wherein the individual canopy weight is stacked by orienting the individual canopy weight such that the leg slot aligns with the individual leg, by moving the individual canopy weight horizontally until the individual leg is at the center of the individual canopy weight, and by lowering the individual canopy weight.

* * * * *